US011103916B2

(12) United States Patent
Larrucea De La Rica et al.

(10) Patent No.: US 11,103,916 B2
(45) Date of Patent: Aug. 31, 2021

(54) SWAGING DEVICE AND PRESS

(71) Applicant: CIE Automotive, S.A., Bilbao (ES)

(72) Inventors: Francisco Larrucea De La Rica, Bilbao (ES); Virginia Manso Rodríguez, Bilbao (ES)

(73) Assignee: CIE Automotive, S.A., Bibao (ES)

( * ) Notice: Subject to any disclaimer, the term of this patent is extended or adjusted under 35 U.S.C. 154(b) by 328 days.

(21) Appl. No.: 16/099,051

(22) PCT Filed: May 5, 2016

(86) PCT No.: PCT/ES2016/070345
§ 371 (c)(1),
(2) Date: Nov. 5, 2018

(87) PCT Pub. No.: WO2017/191334
PCT Pub. Date: Nov. 9, 2017

(65) Prior Publication Data

US 2019/0134698 A1 May 9, 2019

(51) Int. Cl.
*B21J 5/08* (2006.01)
*B21J 9/06* (2006.01)
(Continued)

(52) U.S. Cl.
CPC . *B21J 5/08* (2013.01); *B21J 9/06* (2013.01); *B21J 13/00* (2013.01); *B21K 1/08* (2013.01)

(58) Field of Classification Search
CPC ..... B21J 9/00; B21J 9/02; B21J 9/06; B21J 13/00; B21J 13/025; B21J 13/02;
(Continued)

(56) References Cited

U.S. PATENT DOCUMENTS 1,984,021 A * 12/1934 Johnson ..... B21J 13/025 72/397
3,348,407 A * 10/1967 Rut ..... B21J 13/025 72/450
(Continued)

FOREIGN PATENT DOCUMENTS

DE 112010005886 T 7/2013
DE 112010005886 T5 * 7/2013 ..... F16C 3/08
(Continued)

OTHER PUBLICATIONS

International Search Report and Written Opinion of corresponding PCT Application No. PCT/ES2016/070345, dated Jan. 31, 2017.

*Primary Examiner* — Teresa M Ekiert
*Assistant Examiner* — Sarkis A Aktavoukian
(74) *Attorney, Agent, or Firm* — Gardner, Linn, Burkhart & Ondersma LLP

(57) ABSTRACT

A swaging device includes a top die and a bottom die that can move in a vertical direction between an open position and a closed position. Each die includes an inclined surface, and the device further includes swaging elements each having a complementary inclined surface that is in contact with the inclined surface of each die, both in the open position and in the closed position. The swaging elements are arranged opposite one another such that in at least any position other than the open position, they are in contact by certain non-inclined surfaces opposite the complementary inclined surfaces.

6 Claims, 4 Drawing Sheets

(51) Int. Cl.
*B21K 1/08* (2006.01)
*B21J 13/00* (2006.01)

(58) Field of Classification Search
CPC ..... B21J 5/08; B21J 7/18; B21J 7/02; B21J 13/03; B21K 1/08; B21D 19/086; B21D 37/08
USPC ..... 72/370.13
See application file for complete search history.

(56) References Cited

U.S. PATENT DOCUMENTS

| | | | | |
|---|---|---|---|---|
| 8,813,358 | B2 * | 8/2014 | Ohnuma | B21J 13/03 29/888.08 |
| 2013/0247642 | A1 * | 9/2013 | Lazorkin | B21J 13/02 72/360 |

FOREIGN PATENT DOCUMENTS

| | | | | |
|---|---|---|---|---|
| EP | 2893991 | | 7/2015 | |
| FR | 2529113 | | 12/1983 | |
| FR | 2529113 | A1 * | 12/1983 | B21J 9/06 |
| GB | 622938 | | 5/1949 | |
| GB | 622938 | A * | 5/1949 | B21K 1/08 |
| JP | 05184746 | | 10/1995 | |

* cited by examiner

SWAGING DEVICE AND PRESS

FIELD OF THE INVENTION

The present invention relates to swaging devices and presses that can be applied to the metallurgical industry and, more specifically, to the field of forge-shaping.

BACKGROUND OF THE INVENTION

Hot steel forging processes with vertical presses are known, in which, before achieving a specific final piece, which can be complicated, such as in the case of a crankshaft, a significant amount of material is wasted, given the sequence of operations that are necessary to perform until achieving the shape. This excess material, or flash, is due to the dimensioning of the workpiece that is done based on the most disadvantaged section of the piece to be forged, obtaining excessive excess material for pieces with highly irregular volumes. The indicator for any piece used to measure the amount of excess material is called the Load factor (Fc), which is obtained by the relationship of the weight of the steel of the workpiece and the weight of the finished piece. This indicator allows for a comparison with regard to the use of material in current processes of free hot forging. There are currently different special methods for optimizing the load factor of the workpiece before the previous and final shaping of the pieces in the vertical press.

The methods of the state of the art with a preform workpiece basically consist of the following:

Rolling, which can be longitudinal or transverse.

Horizontal swaging, which can be free or with shapes.

Other methods, such as rotary forging.

However, these preform processes for subsequent hot forging have a series of drawbacks, as will be explained below:

- They imply the use of external installations on production lines which lead to greater expenses in terms of investment and greater technical difficulties that affect the final product in terms of quality and cost.
- Technical complexity of the process, due to the increase in the amount of factors to control, which implies a reduction in efficiency.
- Due to the fact that there are operations that are external to the conventional hot forging process, an excessive cooling of the workpiece is produced, which leads to an increased wear of the forging die, causing certain difficulty in maintaining an optimum life cycle for the equipment, with the consequence of having a greater amount of machine stoppage and production lines, in addition to a limitation of close tolerances.
- There are sharp increases in the energy consumption of the process.
- Based on the complexity of the processes, bottlenecks are created in the installations, which alters the production cycle of the process.
- They require additional personnel that have experience in controlling the process.
- In the case of horizontal swaging, part of the bar that is not going to be deformed has a cold temperature, which leads to a posterior heating of the entire workpiece, considerably increasing the aforementioned energy consumption.

SUMMARY OF THE INVENTION

The present invention relates to a swaging device, as well as to a press that comprises the device, although the device can be incorporated in any forging machine, which allows for a significant reduction in the time and costs associated with the process, as well as in the amount of excess material, given that the dimensions of the workpiece are able to be reduced with respect to the processes and machines of the state of the art for obtaining a same final piece. The swaging device and press provides an improvement in the hot forging process of steel with vertical presses, known as drop forging, reducing excess material, known as flash, which is produced during the drop forging, until the final forged product is achieved. The swaging device and press may eliminate the need for certain specific machinery and extra steps found in prior art processes and systems.

The device proposed by the invention comprises a top die and a bottom die that can be fastened to a forging press, in such a way that the dies can move vertically between and open position and a closed position, such that in the closed position the distance between the dies is less than in the open position.

Now, according to one aspect of the invention, each die comprises at least a surface that is inclined with respect to the vertical direction. Likewise, the device comprises at least two swaging elements, wherein each swaging element has a complementary inclined surface that is in contact with the inclined surface of each die, both in the open position and in the closed position. The at least two swaging elements are arranged facing one another, such that in at least any position different from the open position, they are in contact by means of non-inclined surfaces, opposite the complementary inclined surfaces, in other words, in the open position they can also be in contact by the non-inclined surfaces.

This way, the waste of material when forging any piece, such as in the case of crankshafts, is reduced, this waste being greater the more asymmetrical the geometry of the crankshaft is.

One embodiment of the invention uses the very press in which the forging is carried out to do the longitudinal swaging, which until now was usually done transversely by sections.

Therefore, according to an embodiment of the invention, the position according to a longitudinal direction, perpendicular to the vertical direction of the swaging elements, is different in the open and closed positions.

According to a preferred embodiment, it is envisaged that the non-inclined surfaces are contained on a plane that is perpendicular to the vertical direction.

Likewise, each swaging element can be maintained joined to the respective die thereof, with the possibility of sliding with respect to the inclined surface, by guides or guide means, which prevents the separation thereof and collaborates in defining the sliding trajectory.

With the aim of reducing the impact between the swaging element and the die, as well as of returning the swaging elements to their original position when the device passes from the closed position to the open position, it is envisaged that the device comprises elastic elements or elastic means between each swaging element and the corresponding die thereof.

Optionally, according to another aspect of the invention a press for a forge is provided, which includes a swaging device like the one previously described.

These and other objects, advantages and features of the invention will become apparent upon review of the following specification in conjunction with the drawings.

BRIEF DESCRIPTION OF THE DRAWINGS

As a complement to the description provided herein, and for the purpose of helping to make the characteristics of the invention more readily understandable, in accordance with a preferred practical exemplary embodiment thereof, the description is accompanied by a set of figures constituting an integral part of the same, which by way of illustration and not limitation represent the following.

DESCRIPTION OF THE PREFERRED EMBODIMENTS

Figure 1:
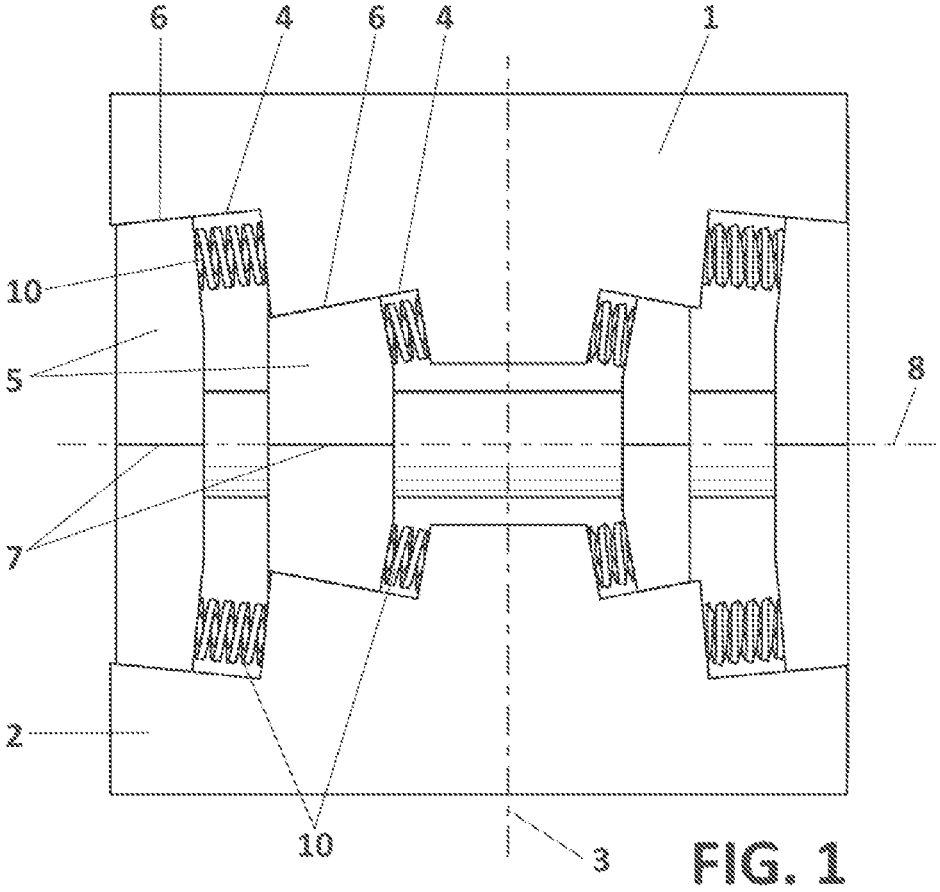
FIG. 1 shows an elevation schematic view of a device in accordance with the present invention, shown in the open position.

With reference to the figures described, one can see how in one of the possible embodiments of the invention, the swaging device includes a top die 1 and a bottom die 2 that can be fastened to a forging press, in such a way that the dies 1, 2 can move vertically 3 between and open position and a closed position, such that in the closed position the distance between the dies 1, 2 is less than in the open position.

Each die 1, 2 comprises at least an inclined surface 4 with respect to the vertical direction 3, the device comprising at least two swaging elements 5, wherein each swaging element 5 has a complementary inclined surface 6 that is in contact with the inclined surface 4 of each die 1, 2, both in the open position and in the closed position, the at least two swaging elements 5 being arranged opposite one another such that in at least any position other than the open position they are in contact by certain non-inclined surfaces 7 opposite the complementary inclined surfaces 6.

As can be seen in the figures, the position according to a longitudinal direction 8, perpendicular to the vertical direction 3 of the swaging elements 5, is different in the open and closed positions.

In the embodiment shown, wherein the press is not shown, the non-inclined surfaces 7 are contained on a plane that is perpendicular to the vertical direction 3.

Each swaging element 5 is maintained joined to the respective die 1, 2 thereof, with the possibility of sliding with respect to the inclined surfaces 4, 6, by guides or guide means 9, which consists of a longitudinal guide.

Likewise the device comprises elastic elements or elastic means 10 between each swaging element 5 and the corresponding die 1, 2 thereof, consisting of springs.

An objective of the present invention is to make a specific tool which, in a single operation, is able to carry out a swaging in the longitudinal direction in a vertical press intended for free hot forging in order to reduce the load factor. This achieves a reduction in raw material.

Moreover, the tool has been designed taking into consideration the dimensioning of current production lines, and therefore does not imply an additional investment in machinery, thereby avoiding the costly integration thereof on automated lines for forging crankshafts.

Figure 7:
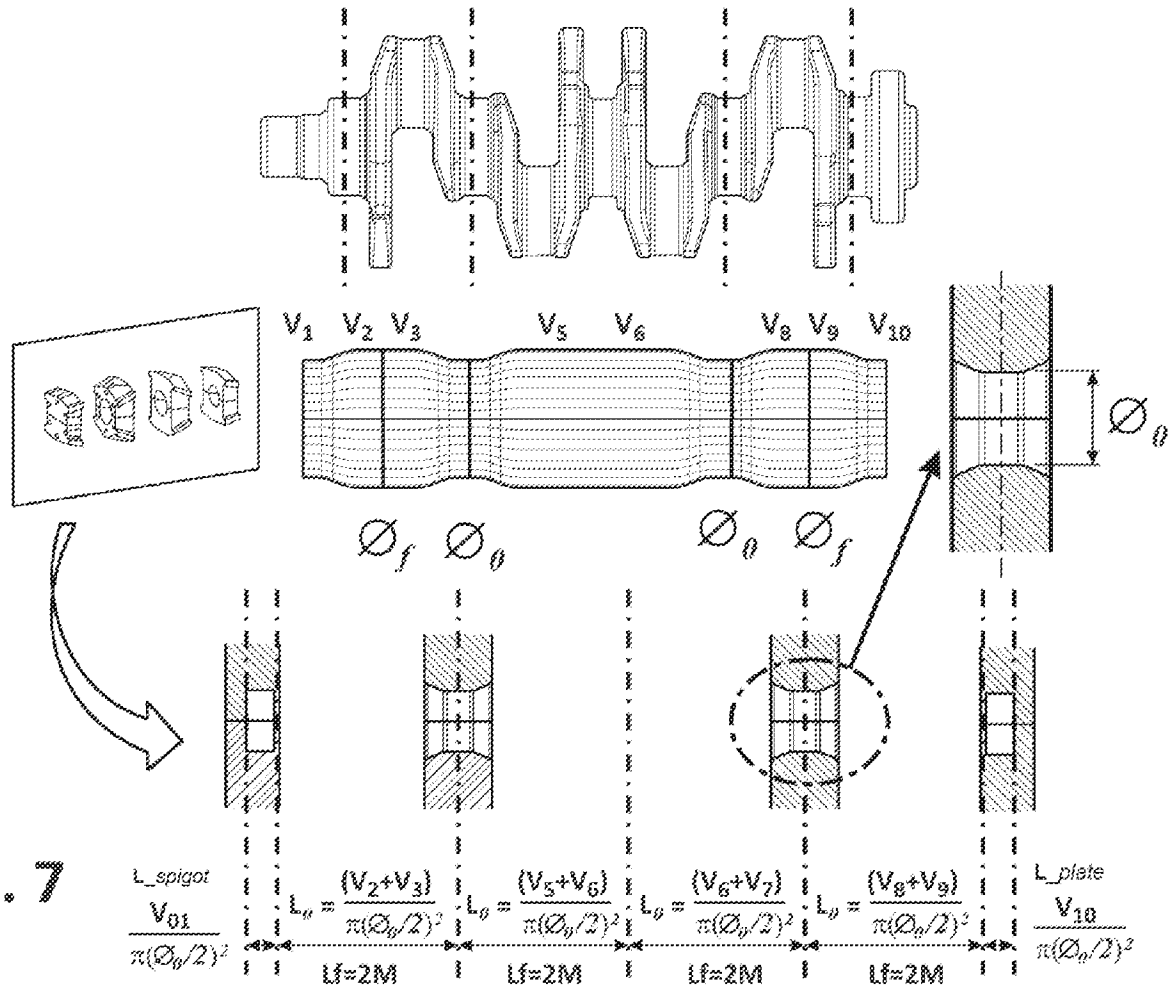
FIG. 7 shows a diagram of the different sections to shape on a billet to obtain a crankshaft.

The longitudinal swaging in vertical hot forging comprises a tool able to shape a workpiece in a single blow. As can be seen in the diagram of FIG. 7, which shows the production of a four-cylinder crankshaft, four counterweights and elliptical elements, the following steps for obtaining the piece are considered. Although this embodiment shows the production of a crankshaft, this same example is valid for producing any other piece with a variable volume, the volumetric gradient of which is around 10%.

The piece has irregular volumes throughout the entire length thereof, which is common. Up to the present, in processes of the state of the art, the workpiece to begin to be forged was extracted from the most disadvantaged section, which is why it has a high load factor, an aspect which is improved by the disclosed swaging device.

As described herein, the formulas and the process for redimensioning the workpiece are mathematically developed according to the most disadvantaged section. To do so, the limits of the process are studied, leading to a new method for calculating the distribution of the volumes as a function of the geometric characteristics.

This is achieved with the disclosed swaging device and method, given that conceptually this new swaging process is able to be integrated into current installations and more commonly within hot forging, thereby avoiding investment in new machinery and the resulting material specializations thereof.

According to the disclosed swaging device and method, the vertical movement of the press and the die is converted into a longitudinal movement of the swaging elements, with the aim of distributing the volume as required by the piece:

The swaging device comprises the definition of ramps which make the swaging elements move in a longitudinal direction. This is due to the fact that the presses have specific strokes according to the subsequent forging steps that are situated on the same base, aiming to make this new process completely flexible and introducing it in the same production line of the component without affecting the production cycle thereof.

The definition of these ramps is important for overcoming the forces of friction that may occur.

Therefore, these movements are determined and must be synchronized according to:

- The limits of the process, which will be determined by:
  - Volumetric data to identify the convenience of the swaging process.
  - Limits to the deformation of the workpiece, to avoid the risk of buckling. This way, satisfactory grain flow lines are obtained to guarantee an optimum forging process in the subsequent steps.
  - Design criteria for the tool, wherein the limits of the measurement of the press and stroke, the friction to be taken into consideration, as well as the dimensions of the die sets are presented.
- The swaging and volumetric parameters with the respective formulation thereof.
- Tool dimensions, according to the values extracted from the previous formulation.

Therefore, we have decided to create a die concept that has longitudinal carriages able to reorient the volumes, with the object of reducing the load factor, in other words, eliminating excess material as well as all of the advantages implied by the same.

A preferred embodiment focuses on the use of presses, for reasons of availability, given the extensive use thereof. In this sense, one new aspect is the integration of longitudinal swaging in presses.

The dimensional definition of the longitudinal swaging tool directly depends on the stroke of the press and the opening of the press, also referred to as light in the top dead centre position.

Therefore, the swaging tool adjusts to this characteristic of a limited stroke (C), in other words, the clearance to respect is always the stroke of the press.

Considering that the swaging device or tool can be integrated into the press and production line of the same piece to be forged, in the preferred embodiment, a crankshaft; ideally it would be the longitudinal swaging die that adjusts to the XYZ dimensions of the dies with the aim of using the designed structure of the die sets, however, as was previously mentioned, the swaging tool has to adjust to the stroke (C) of the press. Therefore, to respect the parameter of the stroke, the longitudinal swaging elements proposed described herein move longitudinally by means of ramps at the same time that the press reaches its closed position.

By lowering the press, the swaging tools come into contact with each other, and thanks to the ramps/guides included in the die and to the reaction force transmitted by the vertical movement of the press, they move longitudinally.

Thus, the definition of the angle of these ramps is important and is related to the minimum angle necessary to overcome the forces of friction, in addition to being linked to the swaging lengths of the block.

The tools at the ends move more than those in the centre, the value depending on the volume of the piece, which is due to the fact that the angle of the ramp β and the height of the die must not be greater than the height of the die box (PT).

We must therefore consider that the slope or inclination of the ramp has to be sufficient so that the corresponding component of the force exerted by the press exceeds or overcomes the force of friction between both surfaces.

To define the variables of the process, the system for defining the crushing to be carried out is analysed.

First, a volumetric analysis of the piece is carried out, in the case of the present embodiment a crankshaft, by which maximum and minimum volumes are obtained. It must be considered that to these volumes the Fc (objective load factor) has already been applied.

The workpiece ($Ø_0$), which is obtained based on the most advantaged section, which coincides with the V min and the formulation thereof is the following (in this type of crankshaft, this V min is usually given in ($V_3$, $V_4$, $V_7$ and $V_8$)).

$$\pi(Ø_0/2)^2 = V\,\mathrm{min}/M$$

Therefore $Ø_0 = 2(V\ \mathrm{min}/M\pi)^{1/2}$

We then obtain the value of the diameter ($Ø_f$) to swage (to increase) to adjust to the volume of the piece.

$$\pi(Ø_f/2)^2 = V\,\mathrm{max}/M$$

Therefore $Ø_f = 2(V\ \mathrm{max}/M\pi)^{1/2}$

The final swaging lengths (Lf) are known, which is 2 times the module $$Lf = 2\ M$$

Due to the similar symmetry or values of the volume (of $V_2$ to $V_9$) we extract:

These final lengths are equal to the final position of the swaging tools that are a presented below.

On the other hand, knowing the initial diameter of the workpiece and the sum of the volumes of the component ($V_1 \ldots V_{10}$) multiplied by the objective load factor, it is possible to know the length of the workpiece to be swaged.

$$L_{workpiece} = (\Sigma(V_1 \ldots V_{10}) * Fc)/\pi(Ø_0/2)^2$$

As was indicated, the length of the block is related to the initial positions of the swaging tools.

Each swaging tool has three springs that work by compression, in subsequent studies progress will be made on the optimum calculation of the characteristics thereof.

Figure 2:
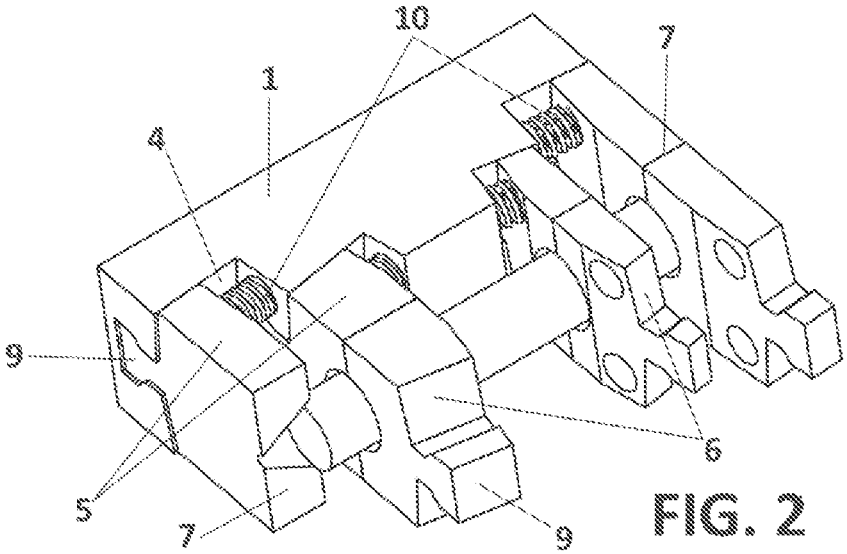
FIG. 2 shows a perspective view of the device of FIG. 1, shown without the bottom die and one of the swaging elements.
Figure 3:
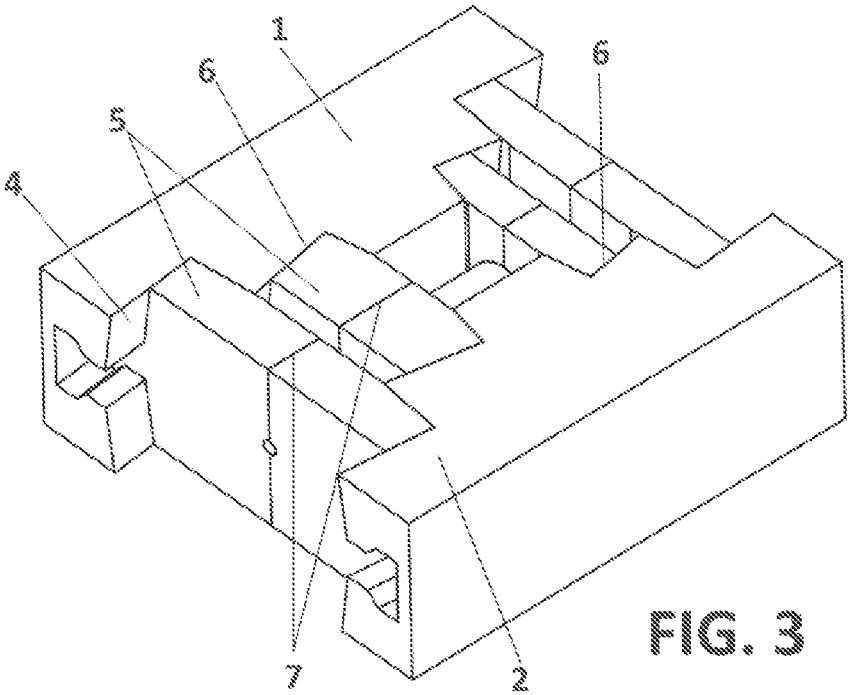
FIG. 3 shows a perspective view of the device in the closed position.
Figure 4:
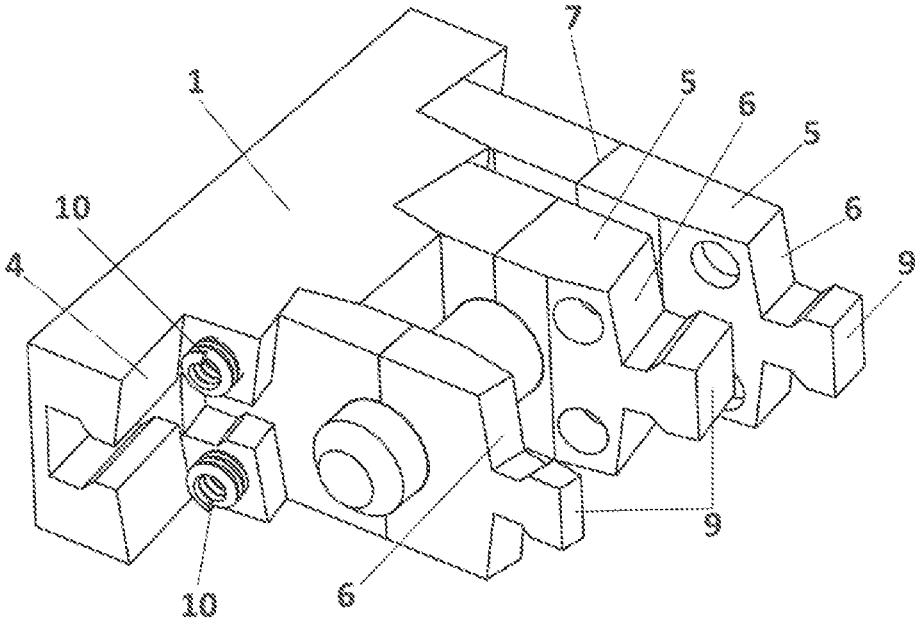
FIG. 4 shows a perspective view of the device represented in FIG. 3, shown without the bottom die and two of the swaging elements.
Figure 5:
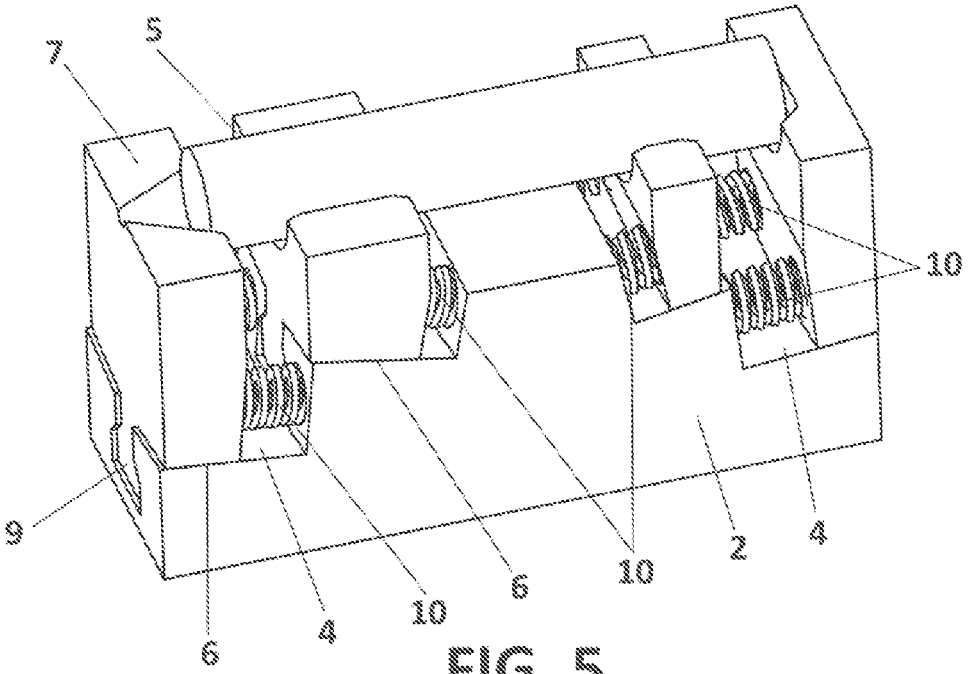
FIG. 5 shows a schematic perspective view of only the bottom die and with the swaging elements in the open position and an unshaped workpiece or billet.
Figure 6:
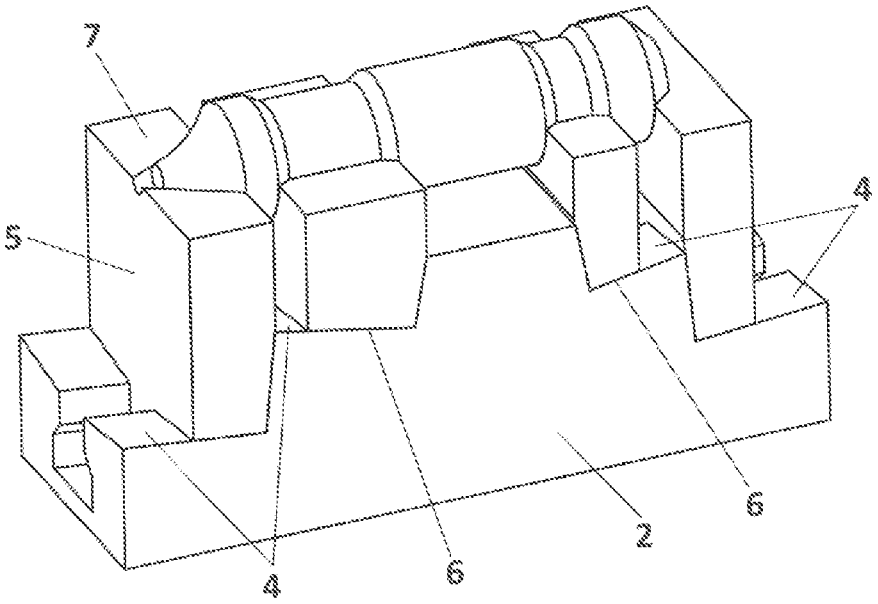
FIG. 6 shows a schematic perspective view like that of FIG. 5, shown in the closed position and with the piece already formed.

FIGS. 1, 2 and 5 show the tool open, while FIGS. 3, 4 and 6 show the tool closed, such that the tools come in into contact and thanks to the reaction of the force due to the lowering of the press and the overcoming of the force of friction, the same become synchronized and begin to simultaneously move in a longitudinal and vertical direction. In the closed position, the press is in the bottom dead centre position and the longitudinal movement is at the end of its stroke.

The dimensions of each swaging tool have to be dimensioned in a smooth way, and thanks to experience in other projects, for example a chamfer with a 30° angle, it allows the swaged material to not have to experience an abrupt change, since the material tends to copy the geometry of the tool, and 0.5 M of a straight part is considered.

The total width of the swaging elements initially defined is a minimum of 1 M in total, as long as it is not a small width in terms of the stresses due to the shaping.

This value varies as a function of the results from the forging simulation of the longitudinal swaging.

In light of this description and the set of figures, a person skilled in the art will understand that the embodiments of the invention that have been described can be combined in multiple ways within the object of the invention. While preferred embodiments have been described herein, it will be evident to the person skilled in the art that multiple variations can be introduced in the preferred embodiments without departing from the object of the invention as has been claimed.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A swaging device comprising:

a top die and a bottom die each having an inclined surface with respect to a vertical direction; and at least two swaging elements;

wherein the dies are fastenable to a forging press and are configured to move in the vertical direction between an open position and a closed position, such that in the closed position a distance between the dies is less than a distance between the dies in the open position;

wherein the swaging elements are configured to move in a longitudinal direction, perpendicular to the vertical direction of the dies, from a first position when the dies are in the open position to a second position when the dies are in the closed position;

wherein each swaging element has a complementary inclined surface for urging the swaging elements in the longitudinal direction, wherein the complementary inclined surface is in contact with the inclined surface of each die both in the open position and in the closed position;

wherein each swaging element has a non-inclined surface opposite the respective complementary inclined surface; and wherein the swaging elements are arranged opposite one another such that in die positions other than the open position, the swaging elements are in contact with each other at their respective non-inclined surfaces.

2. The device according to claim 1, wherein each swaging element is configured to maintain contact with the respective die thereof during sliding movement with respect to the inclined surfaces of the dies.

3. The device according to claim 1, wherein the non-inclined surfaces are contained on a plane perpendicular to the vertical direction.

4. The device according to claim 2, wherein the swaging elements comprise respective longitudinal guides configured to maintain contact of the swaging elements with the respective dies, and to permit sliding movements of the swaging elements with respect to the inclined surfaces of the dies.

5. The device according to claim 1, further comprising an elastic element between each swaging element and the corresponding die thereof.

6. A forging system comprising the forging press and the device according to claim 1.

* * * * *